United States Patent [19]

Egberg

[11] Patent Number: 4,865,371

[45] Date of Patent: Sep. 12, 1989

[54] APPARATUS FOR DISPOSING OF ANIMAL EXCREMENT

[76] Inventor: David Egberg, 2845 Jewel La., Plymouth, Minn. 55447

[21] Appl. No.: 97,735

[22] Filed: Sep. 17, 1987

[51] Int. Cl.[4] ..... A01K 29/00; B65D 69/00

[52] U.S. Cl. ..... 294/1.3; 15/104.8; 15/257.6; 206/524.3; 229/231 BT; 428/905

[58] Field of Search ..... 294/1.3–1.5, 294/55; 15/104.8, 257.1, 257.6; 119/95; 206/204, 205, 223, 496, 524.1, 524.3–524.6, 819; 220/1 T, 1 S, 87, 345, 350, 351, 403, 404, 417, 454, 457, DIG. 11; 229/3.5 R, 9, 19, 23 BT, 120.01, 52 B; 428/905

[56] References Cited

U.S. PATENT DOCUMENTS

| | | | |
|---|---|---|---|
| D. 262,943 | 2/1982 | Schadler | 294/1.3 X |
| 1,836,297 | 12/1931 | Vienna | 220/87 |
| 1,990,026 | 2/1935 | Glen | 15/257.6 |
| 3,575,140 | 4/1971 | Prepeliczay . | |
| 3,599,859 | 8/1971 | Maierson . | |
| 3,755,064 | 8/1973 | Maierson . | |
| 3,955,706 | 5/1976 | Whitaker | 220/87 |
| 4,017,015 | 4/1977 | Jefferson | 294/55 X |
| 4,154,389 | 5/1979 | Dell'Anno | 294/55 X |
| 4,164,314 | 8/1979 | Edgar . | |
| 4,305,544 | 12/1981 | Noonan . | |
| 4,333,569 | 6/1982 | Hammacher . | |
| 4,355,758 | 10/1982 | Lavery . | |
| 4,471,871 | 9/1984 | Rockliffe et al. . | |
| 4,474,324 | 10/1984 | Forbes | 229/23 BT |
| 4,518,115 | 5/1985 | Sedwick . | |
| 4,664,064 | 5/1987 | Lowe . | |

FOREIGN PATENT DOCUMENTS

| | | | |
|---|---|---|---|
| 122041 | 10/1984 | European Pat. Off. | 206/524.4 |
| 2587876 | 4/1987 | France | 294/1.3 |

*Primary Examiner*—Johnny D. Cherry
*Attorney, Agent, or Firm*—Hugh D. Jaeger

[57] ABSTRACT

Method and apparatus for disposing of animal feces including a two piece box which folds out from a collapsible flat shape. The interior of this box is layered with a moisture impermeable material which is coated with a water soluble mixture. The water soluble mixture contains an aroma and a disinfectant, so when the surface comes into contact with moist feces, the aroma and disinfectant are released. The released aroma masks the feces odor, and the released disinfectant decreases microbiological growth, making the transportation and storage of the feces more acceptable until final disposal, burial or incineration. An alternative apparatus features an interior plastic bag linear for each of the box halves.

6 Claims, 4 Drawing Sheets

APPARATUS FOR DISPOSING OF ANIMAL EXCREMENT

BACKGROUND OF THE INVENTION

1. Field of the Invention

The present invention relates to a method for scooping, transporting and disguising animal feces. A fold-out, two-piece, disposable box is used to scoop, transport and disguise the animal feces. The box is comprised of a male and female section. When they are to be used, the flat male and female box halves unfold and snap open, forming the box components. The feces is scooped by pushing the male box half into the female box half, thereby enveloping the feces. The box, with a carrying handle or optional plastic bag lining, is formed around and about the feces which are no enclosed within the box.

A further feature of the present invention is that the interior of the formed box is layered with a moisture-impermeable substance such as polyethylene. The polyethylene may be coated with a normally dormant, moisture activated mixture containing an aroma and disinfectant. When the moist feces comes in contact with the coated box interior surface, the moisture dissolves the active ingredients and releases the aroma and disinfectant. The aroma masks the feces odor, and the disinfectant slows odor production by killing the feces bacteria.

2. Description of the Prior Art

The disposal of animal feces in populated areas, such as cities o mobile home parks, is a major problem for the pet owner. The owner will usually carry gloves or a scoop, and then place the feces in a bag for transportation and disposal. This method is obviously dirty and unsavory, and does not lend itself to transportation of the feces any substantial distance for sanitary disposal. The method is lacking and is in need of improvement.

The present invention overcomes the disadvantages of the prior art by providing a clean and easy method to accomplish the task of transportation and disposal of animal feces.

SUMMARY OF THE INVENTION

The general purpose of the present invention embodies a novel method and apparatus to scoop, transport and disguise animal feces. The present invention improves on prior art by providing a novel two-piece box design. Each component is flat and collapsible for convenient portability. Upon use, each flat, preformed box is simply folded open, automatically locking into place. The two box component halves are designed so that the male part slips into the female portion enveloping the feces and forming a box with a substantially tight pressure-fit seal. An alternative design includes a plastic bag liner affixed to the interior of each fold open box half.

One significant aspect and feature of the present invention is a box for the transportation of feces, which is designed with a handle for easy carrying.

Another significant aspect and feature of the present invention is that the box disguises the feces by decreasing and masking the odor. The moisture from the feces causes the release of a disinfectant and an aroma that is coated on the interior surface of the box. The present invention embodies a unique portable box design that functions as both a scoop and a carrying receptacle. It is unobtrusive, more convenient and much cleaner than the prior art scoop methods currently in use.

A further significant aspect and feature of the present invention is that the interior of the box contains a disinfectant and aroma to help mask the feces odor until it can be burned or buried or otherwise disposed of. No current technique is available to accomplish this task.

Yet another significant aspect and feature of the present invention are flat, low profile, easily stored box halves which are erected to form box halves.

Yet a further significant aspect and feature of the present invention is a box which includes a plastic bag lining on the interior of each box half.

DESCRIPTION OF THE DRAWINGS

Other objects of the present invention and many of the attendant advantages of the present invention will be readily appreciated as the same become better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
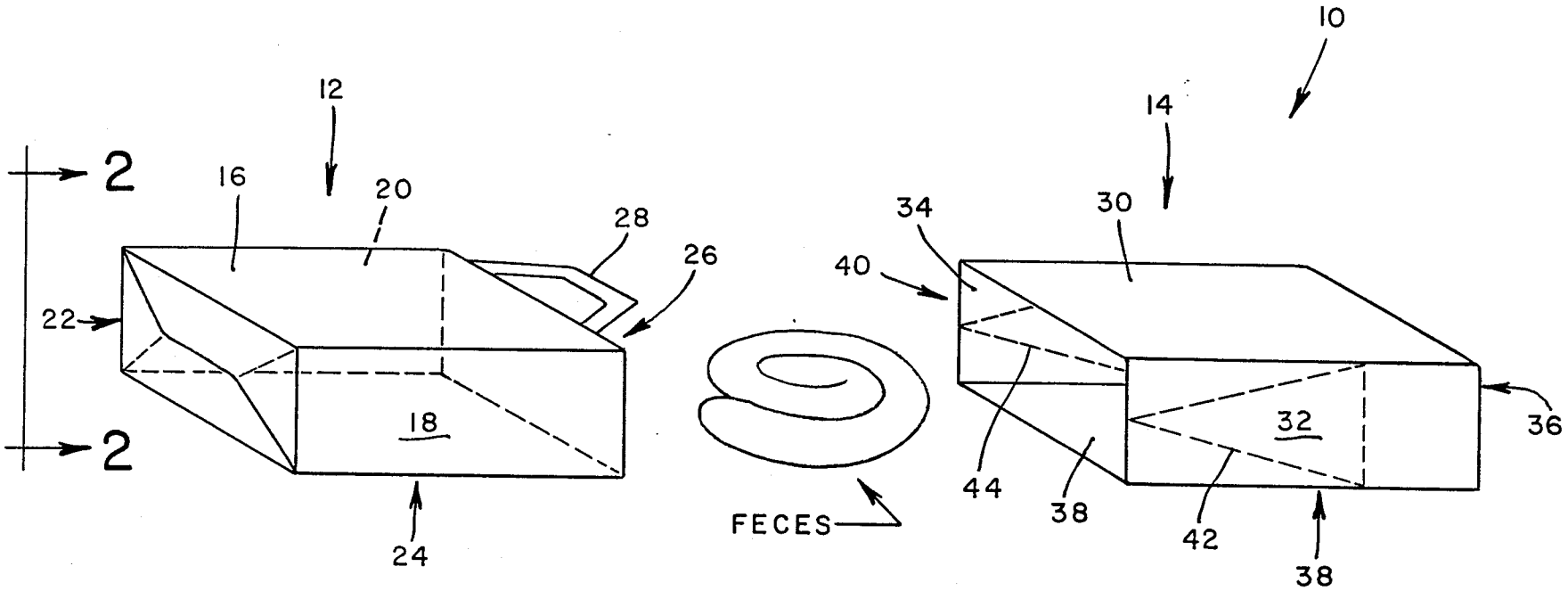
FIG. 1 illustrates a box separated into box halves.

FIG. 1 illustrates a perspective view of a box apparatus system 10 for disposing of animal excrement including a female box half 12 and a male box half 14. The female box half 12 includes a side 16, a side 18, a side 20 opposing side 18, an end 22 which snaps and locks into place as later described in detail, a side 24 opposing the side 16, an open end 26, and a handle 28 affixed to side 16. The male box half 14 is slightly smaller than the female box half 12 to be accommodated by the female box half 12 for a pressure fit, and includes a side 30, a side 32, a side 34, a side 38, an end 36 similar to end 22 which snaps and locks into place, and an open end 40. Sides 32 and 34 include triangular scoring line creases 42 and 44 as later described in detail.

Figure 2:
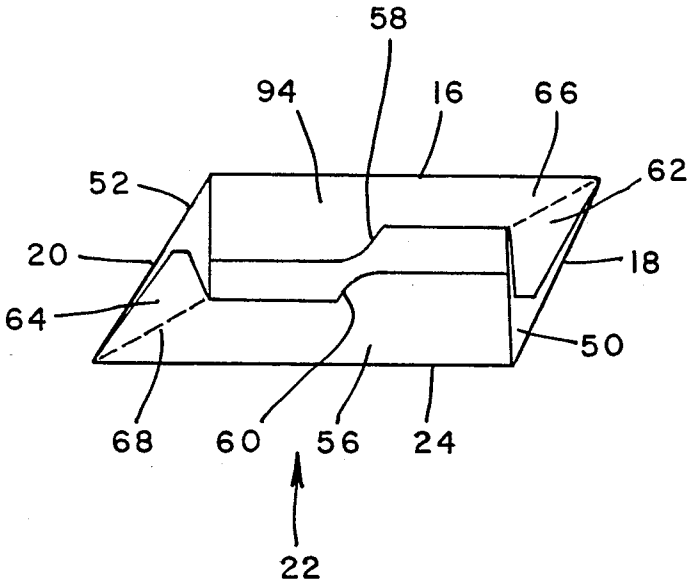
FIG. 2 illustrates an end view of semi-erectile female box half taken along aspect line 2—2 of FIG. 1.

The box may be fabricated from paper board stock with an interior which has been layered with a water impermeable plastic. A typical thickness of the board stock is 0.020 inches by way of example. Both the male 14 and the female 12 box halves are constructed with ends 36 and 22, respectively, that snap and lock into place when the flat sides 16, 18, 20, 24 and 30, 32, 34, and 38 are folded open, as also illustrated in FIG. 2. The female box half 12 is designed with a carrying handle 28 to provide convenient transportation when the final receptacle is formed around the feces.

The width and height of the male box half 14 is slightly less than the width and height of the female box half 12 so that the male box half 14 can be slipped inside, thereby enveloping the feces. Furthermore, the sides of the male box half 14 are creased, aiding the insertion of the male box half 14 into the female box half 12. A pressure fit holds the two box halves 12 and 14 together to provide a sealed container.

In accordance with the present invention, the box 10 may be formed from various materials. The box 10 could be formed from cardboard, layered with moisture-impermeable plastic so it forms a moisture barrier inside the box. Such plastic materials would include, but not be limited to, polyethylene, polypropylene, polyvinylidene chloride or polyvinylchloride. If only short term moisture-impermeability is desired, then the plastic layer may be omitted.

In accordance with the present invention, the box 10 may be formed from cardboard which has been coated with moisture-releasable substances, including odorants to mask the feces odor, and disinfectants to kill microorganisms that cause feces odor. The entrapped substances are held in a water-soluble polymer until the polymer is dissolved by the feces moisture, thus causing their release.

Any number of odor masks could be used. These would include pine or citrus scents, or any other number of commercial odorants.

Water soluble polymers that are useable in the coating process would include gum arabic, cellulose derivatives such as methyl hydroxypropylcellulose and carboxymethylcellulose, maltodextrins, carrageenan, certain proteins such as zein, casein or gelatin and synthetic polymers such as polyethylene glycol and polyvinyl alcohol.

Disinfectants that are useable in this process would include glutaraldehyde, GIV Guard DXN TM, and quaternary ammonium salts. Different water-soluble polymers and anti-microbial agents can also be utilized.

The coating is put on the box material by depositing a dispersion/solution of the active ingredient in a carrier liquid such as water. This aqueous dispersion solution is deposited onto the box material with a spray, roller or other device. A preferred means of depositing the dispersion solution is with a rotograveur cylinder on a printing press. The carrier solvent (water) is dried, leaving an active surface of disinfectant and odorant entrapped in the water-soluble polymer. The box is formed with this active surface as the interior. A typical coating is set forth below in Table 1 in a preferred column, while Table 2 illustrates a column of ranges.

TABLE 1

| Typical Coating Emulsion Formula Preferred Percentage | Weight by Percent |
|---|---|
| Water | 52% |
| Benzalkonium Chloride | 5% |
| Odorant | 5% |
| Water Soluble Polymer | 35% |
| Surfactant (Triton-x100) | 3% |

TABLE 2

| Typical Coating Emulsion Formula Percentage Ranges | Weight by Percent |
|---|---|
| Water | 52% |
| Benzalkonium Chloride | 2–15% |
| Odorant | 2–15% |
| Water Soluble Polymer | 0–35% |
| Surfactant (Triton-x100) | 0.3–5% |

A surfactant may be selected from a vast array of materials including aryl and alkyl sulfonates, Surfynols TM, polyethylene and polypropylene oxide, fluorinated alkyl quaternary ammonium salts or other amine derivatives.

FIG. 2 illustrates the end 22, a semi-erected female half 12, taken along aspect line 2—2 of FIG. 1 which is similar to the male box half end 36 of FIG. 1 where all numerals correspond to those elements previously described. End 36 is not described for purposes of brevity, and operates in a like mode of operation. Sides 16, 18, 20 and 24 each have tabs extending across the bottom area which ultimately unfold from a flat box half to engage with one another to form a planar box bottom 22 as illustrated and also described in FIG. 3. Sides 18 and 20 include triangular flaps 50 and 52, respectively. Sides 16 and 24 each have mirror-like flaps 54 and 56 including lock tabs 58 and 60, respectively, and quadrilateral portions 62 and 64. The quadrilateral portion 62 glues or otherwise affixes over the triangular flap 50 of the side 18, and the quadrilateral portion 64 likewise glues or otherwise affixes over the triangular flap 52 of the side 20. As the box sides are unfolded to form right angles with each other, triangular tabs 50 and 52 affixed to quadrilateral portions 62 and 64 actuate tabs 54 and 56 outwardly towards the plane of the end 2 and bending tabs 54 and 56 along crease lines 66 and 8 towards the plane of the end 22 thereby systematically engaging lock tabs 58 and 60 with each other to form a configuration as illustrated in FIG. 3.

Figure 3:
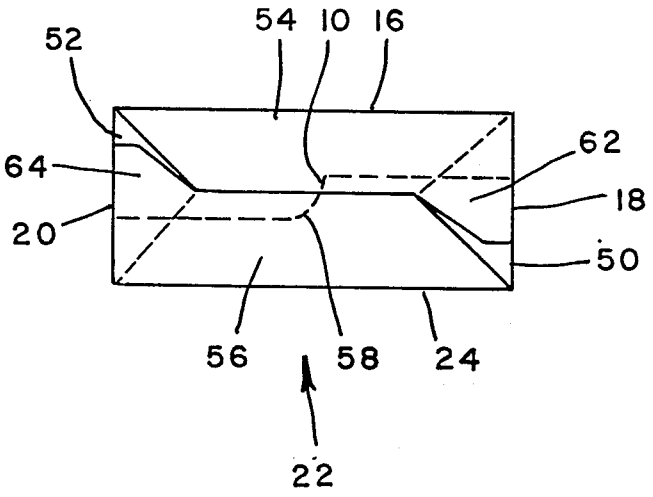
FIG. 3 illustrates an end view of the erected female box half of FIG. 2.

FIG. 3 illustrates an end view of the fully erected box end 22 of FIG. 2 where all numerals correspond to those elements previously described. This loop end is like that of end 36 which is not described for purposes of brevity. The box end 22 is fully formed with lock tabs 58 and 56 engaged with one another after systematic deployment and engagement of the lock tabs by the action of manually erecting the respective box halves from a flat and folded position. End 36 of the male box half 14 is configured and operates in a manner similar to that shown for the female box end 22.

MODE OF OPERATION

The female and male box halves 12 and 14 of the box 10 are transported flat by the user. Prior to use, these sections are opened to form a male box half 14 which is pushed into the female box half 12, enveloping the feces therebetween in the formed box 10. A handle 28 is part of the box design, and is used to transport the feces to the final deposition. The male box half 14 is scored along lines 42 and 44 so that it can be slightly depressed to decrease the box cross section profile, thus facilitating insertion into the female box half 12.

Figure 4:
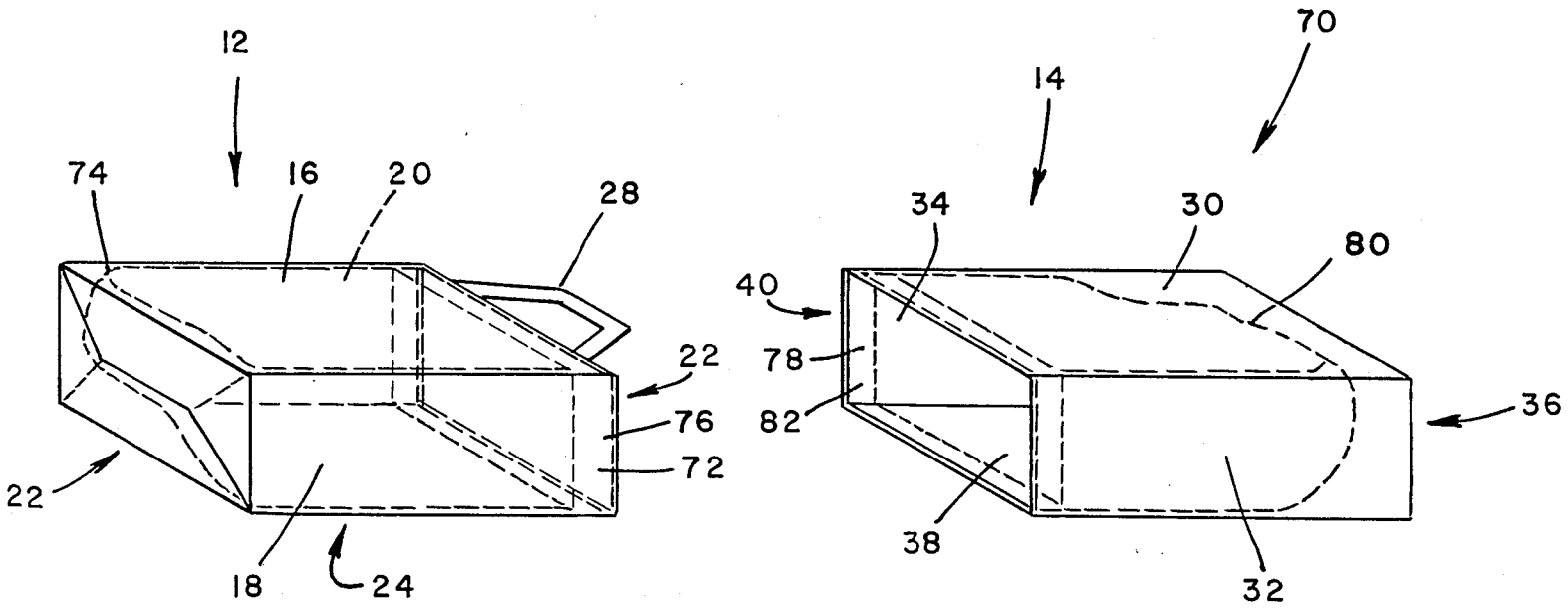
FIG. 4 illustrates a box separated into box halves where each half includes a plastic liner; and, FIG. 5 illustrates a cross section of the box halves mutually engaged.

FIG. 4 illustrates an alternative embodiment of an apparatus 70 including the female box half 12 and a male box half 14, each including a plastic liner bag glued or otherwise affixed to the interior or each of the box halves 12 and 14. Operation of the box halves 12 and 14 is identical to that previously described.

The outer edge opening perimeter 72 of a plastic liner bag 74 is glued, cemented or otherwise affixed to the inner planar perimeter portion 76, bound by the box edge and dashed line, of the box 12. The outer edge perimeter 78 of another plastic liner bag 80 is similarly attached to the inner planar perimeter portion 82 of the box 14, bound by the box edge and a dashed line, as illustrated with a dashed line. Plastic liner bags 74 and 80, each being affixed to the box inner perimeters at the bag liner opening perimeter, are afforded unrestricted movement within the interior of each box 12 and 14 prior to encapsulation of feces within the plastic bag liners 74 and 80 of box halves 12 and 14. When the box halves 12 and 14, containing plastic bag liners 74 and 80, are mutually accommodated, the feces is effectively double barrier sealed between layers of treated box material and layers of plastic liner material. Engaged box halves 12 and 14 are illustrated in FIG. 5.

Figure 5:
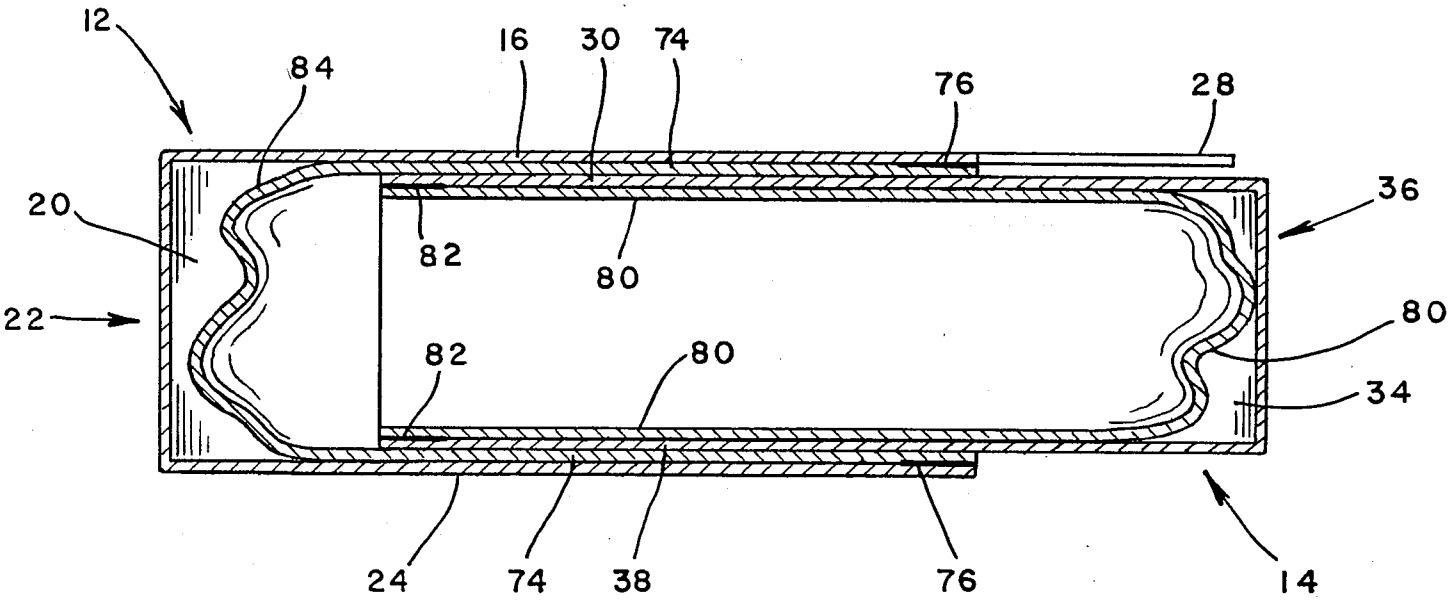

FIG. 5 illustrates a cross section of the box halves 12 and 14 mutually and frictionally engaged and forming a double sealed apparatus 70 for the encapsulation and disposal of feces. Frictional engagement of the male box half 14 and the plastic liner bag 80 within the female box half 12 and the plastic liner bag 74 ensures a double barrier seal consisting of at least a treated box side or end and an enclosed plastic bag member in the area of the box half ends 22 and 36, and a quadruple barrier in the areas where the box sides and bags slide over each other such as the overlapping of box side 16 and plastic liner bag 74 of box 12 with box side 30 and plastic liner bag 80 of box 14. Also shown in this illustration are the areas 76 and 82 where the plastic liner bag perimeter is affixed to the box inner perimeter areas. The double sealed apparatus 70 thus forms a well sealed container offering double or quadruple odor, solid and liquid sealant protection.

Various modifications can be made to the present invention without departing from the apparent scope thereof.

Odorant only may be applied to the box if appropriate packaging is used to protect against odorant loss in distribution.

I claim:

1. An apparatus to scoop, transport and disguise animal feces comprising:

a. male and female box halves of cardboard coated with a solution of
   1. Water—approximately 50%;
   2. Benzalkonium chloride—2–15%;
   3. Water Soluble Polymer—0–35%; and,
   4. Surfactant (Triton-x100—0.3–5%;

b. said male and female box halves including collapsible and folded flat means for storage;

c. said male and said female box halves including means to erect to form box halves;

d. said male and female box halves including a means for systematic deployment and engagement of box end flaps and lock tabs to form a box end; and, e. said male box half including scored lines to decrease a cross section profile of said male box half to facilitate insertion of said male box half into said female box half, whereby said male box half and female box half are pushed together about a feces to envelope said feces within joined box halves, said joined bow halves frictionally engage to form a sealed box apparatus, and said box apparatus is suitable for carriage and disposal of feces.

2. An apparatus to scoop, transport and disguise animal feces comprising:

a. male and female box halves;

b. said male and said female box halves including collapsible and folded flat means for storage;

c. said male and said female box halves including means to erect to form box halves;

d. said male and female box halves including a means for systematic deployment and engagement of box end flaps and lock tabs to form a box end;

e. said male box half including scored lines to decrease a cross section profile of said male box half to facilitate insertion of said male box half into said female box half, whereby said male box half and female box half are pushed together about a feces to envelope said feces within joined box halves, said joined box halves frictionally engage to form a sealed box apparatus, and said box apparatus is suitable for carriage and disposal of feces;

f. a plastic bag liner fixedly attached to an interior edge of said male box half opposite said box end;

g. a plastic bag liner fixedly attached to an interior edge of said female box half opposite said box end; and, h. said male box half with said plastic bag liner frictionally engages said female box half with said plastic bag liner to form a moisture proof box apparatus, whereby said plastic bag liner affixed to said interior edges of said male and female box halves forms a double sealed barrier.

3. A flat, unfoldable, two piece box for pickup and disposal of animal feces comprising:

a. a folded flat female portion expandable to form a receptacle having a carrying handle adjacent an open end thereof;

b. a folded flat male portion expandable to form a receptacle having an open end adapted to fit within the open end of said female portion and a larger closed end to provide a closely fitting seal when said male and female portions are fully joined; and, c. a normally dormant coating containing a moisture activated disinfectant on the inside of said male portion.

4. A box according to claim 3 wherein the inside of said female portion also includes a normally dormant coating containing moisture activated disinfectant.

5. A box according to claim 3 wherein said normally dormant coating contains a moisture activated aroma.

6. An apparatus to scoop, transport and disguise animal feces comprising:

a. male and female box halves coated with a dormant coating;

b. said male and said female box halves including collapsible and folded flat means for storage;

c. said male and said female box halves including means to erect to form box halves;

d. said male and female box halves including a means for systematic deployment and engagement of box end flaps and lock tabs to form a box end; and, e. said male box halves including scored lines to decrease a cross section profile of said male box half to facilitate insertion of said male box half into said female box half, whereby said male box half and female box half are pushed together about a feces to envelope said feces within joined box halves, said joined box halves frictionally engage to form a sealed box apparatus, and said box apparatus is suitable for carriage and disposal of feces.

* * * * *